US006102019A

United States Patent [19]

Brooks

[11] Patent Number: 6,102,019

[45] Date of Patent: Aug. 15, 2000

[54] ADVANCED INTELLIGENT FUEL CONTROL SYSTEM

[75] Inventor: Timothy J. Brooks, Troy, Mich.

[73] Assignee: TJB Engineering, Inc., Troy, Mich.

[21] Appl. No.: 09/226,491

[22] Filed: Jan. 7, 1999

[51] Int. Cl.[7] ..... F02D 41/14

[52] U.S. Cl. ..... 123/674; 701/109

[58] Field of Search ..... 123/674, 703; 701/103, 104, 109; 60/276, 274

[56] References Cited

U.S. PATENT DOCUMENTS

| | | | |
|---|---|---|---|
| 5,253,632 | 10/1993 | Brooks . | |
| 5,492,106 | 2/1996 | Sharma et al. | 123/681 |
| 5,787,867 | 8/1998 | Schnaibel et al. | 123/674 |
| 5,797,261 | 8/1998 | Akazaki et al. | 123/674 |
| 5,845,491 | 12/1998 | Yasui et al. | 701/109 |
| 5,847,271 | 12/1998 | Poublon et al. | 701/109 |
| 6,021,767 | 2/2000 | Yasui et al. | 123/674 |

FOREIGN PATENT DOCUMENTS

| | | | |
|---|---|---|---|
| 6-66186 | 3/1994 | Japan | 701/109 |

*Primary Examiner*—Erick Solis
*Attorney, Agent, or Firm*—Gifford, Krass, Groh, Sprinkle, Anderson & Citkowski, P.C.

[57] ABSTRACT

An Air/Fuel mixture control system for an internal combustion engine which uses a closed loop controller for varying an air/fuel mixture in response to the voltage output of the engine's exhaust gas oxygen sensor. The oxygen sensor will produce a voltage output which is classified in a range extending from very rich, net rich, net lean or very lean depending upon the sensed voltage output in milli-volts. The controller responds to an onset of a lean or rich exhaust signal, representative of either too much or too little oxygen, by instructing the fuel injectors to either increase or decrease the fuel delivery rate to a predetermined rich step value or lean step value. The delivery rate at the rich or lean step value is maintained until the onset of either a rich or lean exhaust indication or until a predetermined rich or lean step duration expires. The controller then responds to the expiration of the rich or lean step duration by selectively increasing or decreasing the fuel delivery rate in a progressive manner from the predetermined rich or lean step values until a rich or lean exhaust indication is produced. The controller than responds to the onset of each rich or lean exhaust indication by abruptly decreasing or increasing the fuel delivery rate to a predetermined lean or rich step value as well as contemporaneously calculating a corrected rich or lean step value which is greater than the initial rich or lean step value. The fuel delivery rate is then maintained at the corrected rich or lean value until the onset of either a lean or rich exhaust indication, at which point the process is repeated. The method of the fuel control system functions to minimize the fluctuations and magnitude of the rich and lean step values and to thereby accomplish more precise adjustments of fuel delivery so as to achieve stoichemetry in the fuel/air mixture.

20 Claims, 8 Drawing Sheets

ADVANCED INTELLIGENT FUEL CONTROL SYSTEM

BACKGROUND OF THE INVENTION

1. Field of the Invention

The present invention relates generally to methods and apparatus for controlling the delivery of fuel to an internal combustion engine and, more particularly, to a method and apparatus for an intelligent fuel control system for optimizing the quantity of fuel delivered to an internal combustion engine and for minimizing errors caused by an engine's age, condition or fuel being utilized, based on past detected performance. Optimization of the fuel control process will allow for the best and most efficient operation of a catalytic converter.

2. Description of the Prior Art

Electronic fuel control systems are increasingly being used in internal combustion engines to precisely meter the amount of fuel required for varying engine requirements. Such systems vary the amount of fuel delivered for combustion in response to multiple system inputs including throttle angle, measured air intake, and the voltage output from the Heated Exhaust Gas Oxygen sensor (HEGO) while analyzing the exhaust gas produced by combustion of the air and fuel.

Electronic fuel control systems operate primarily to maintain the ratio of air and fuel at or near stoichiometry. Electronic fuel control systems operate in a variety of modes depending on engine conditions, such as starting, rapid acceleration, sudden deceleration, cruse and idles. One mode of operation which is of the most importance to us is closed-loop fuel control. Under closed loop control, the amount of fuel delivered is determined primarily by measuring the air entering the engine, calculating the appropriate fuel needs and then correcting the amount of fuel needed based on a voltage output from a HEGO. In this example, a HEGO sensor output with voltages between 0.45 Volts and 1.1 Volts is often considered "Rich", voltages between 0.0 and 0.45 are generally considered "lean". A sensor voltage output indicating a rich air/fuel mixture ( an air/fuel ratio below stoichiometry) will cause the control system to decrease the amount of fuel being delivered. Conversely a HEGO voltage below a value indicating stoichiometry will cause the control system to increase the amount of fuel delivered to the engine.

Modern vehicle engines utilize a three-way catalytic converter to reduce unwanted by-products of combustion also known as regulated emissions. The catalytic converter has a finite number of active sites where the electromotive forces are optimum for a desired electrochemical reaction to take place. The number of active sites limit the mass quantity of reactants that the converter is able to process at any given time.

Maintenance of the ratio of air and fuel at or near stoichiometry is critical for efficient operation of the catalytic converter. In order to effect maximum conversion efficiency from a three way catalyst, discrete cyclical quantities of rich and lean exhaust gasses must be delivered to the catalyst. Occasional richer and leaner cycles of exhaust gasses must be utilized to clean some of the active sites which have been occupied (also known as poisoned) by chemical reactants which have been electro-chemically bonded to these sites. Balancing the excursions between rich and lean exhaust is important in ensuring that an adequate number of active sites in the converter are available for future conversion to take place. A lean air/fuel ratio will oxidize the active sites occupied by "rich" reactants such as carbon monoxide (CO) and Hydrocarbons (HC's), with "lean" reactants such as Oxygen (O2) and Oxides of Nitrogen (NOx). As the rich reactants are removed, the active sites are "charged" with lean reactants which will allow the ensuing rich excursion to reduce these reactants. In this manner, the catalytic converter will attain maximum conversion efficiencies. The magnitude and frequency of the rich/lean excursions should never be large enough to saturate the catalyst. A saturated catalyst is somewhat deactivated until many of the active sites can be cleaned of the occupying chemical or poison.

When altering the air/fuel ratio in response to the detected exhaust gas oxygen sensor voltage output, electronic fuel control systems known in the art respond in a predetermined way to a detected air/fuel ratio. Consequently, factors such as imprecision in the predetermined response, variations from engine to engine, variations in the fuel provided to the engine, aging of parts, and other characterized changes will cause changes in the performance and efficiency of the engine which will then suffer accordingly.

An example of an intelligent fuel control system is disclosed in U.S. Pat. No. 5,253,632, issued to Brooks. Brooks teaches an air/fuel mixture control system for an internal combustion engine in which a closed loop controller varies the air/fuel mixture in response to measurements of the oxygen level within the engine's exhaust emissions to achieve stoichemetry. The oxygen sensor produces a binary sensor signal indicative of either a rich or lean mixture. The controller responds to changes in the binary sensor signal by delivering fuel at a fixed rate until either the sensor responds by indication of an oxygen level change or a predicted transport delay interval expires. In the event the predicted interval expires before the sensor responds, the fixed rate of fuel delivery is adjusted in an effort to obtain the desired level change within the allotted interval. In the event that the level change is delayed beyond a set limit, the transport delay interval is enlarged. If the control system raises the fuel delivery rate above a predetermined rich limit, or below a predetermined lean limit, the base rate from which the initial rates are derived is increased or decreased respectively.

The shortcoming of the Brooks '632 reference is the teaching of the fuel injection wave form (in solid graphical representation) and the sensed oxygen level wave form (in phantom graphical representation) forever modulating in offset fashion from one another aside from momentary intersections at the desired stoichemetric level (represented by centerline 1.0). As is clearly illustrated, the peaks of the wave-shape illustrating the exhaust oxygen levels are delayed from the corresponding peaks of the fuel-intake waveshape, this offset resulting from the physical transport delays resulting from the air and fuel passing through the engine components up to the position of the sensor in the exhaust stream. Thus, the system of Brooks is forever hunting about for a stoichemetric level between the oxygen input and the fuel delivery rate and based only upon the original parameters existing prior to the first cycle of operation.

SUMMARY OF THE INVENTION

The present invention is an advanced intelligent fuel control system which improves the dynamic response by minimizing errors and improves the dynamic performance of an internal combustion process along with catalyst activity tuning to obtain overall higher catalyst conversion efficiencies, lower tail pipe emissions, and increased engine efficiency.

In a control system contemplated by the invention, the engine exhaust gasses are measured by a heated exhaust gas oxygen sensor (HEGO) which will produce a voltage which can be utilized to determine the relative richness or leanness of the engine exhaust gasses. In this example, if a HEGO sensor output is in a voltage range of zero to 150 mV at the expiration of a predetermined exhaust gas transport delay, the exhaust is considered very lean. A base fuel multiplier greater than one will be commanded to cause a rich air/fuel ratio to occur. If the HEGO sensor output voltage is in the 150 mV to 450 mV range, a smaller fuel multiplier value greater than one will be commanded. Conversely, if the HEGO sensor voltage is indicated to be between 450 mV and 850 mV, a slightly rich air/fuel ratio will be indicated with a resulting base fuel multiplier less than one applied. Finally, if the HEGO sensor output is detected in a voltage range of 850 mV to 1100 mV, the indication is very rich. In this example a fuel multiplier less than the previous example, and still less than one, will be commanded. The resulting fuel multiplier determined in each of the four previous examples will be abruptly incriminated to the new desired command response in a somewhat proportional manner until the HEGO indicates a correct air/fuel shift.

The proportional step commanded by the control system will be held at the predetermined value until a predetermined exhaust gas transport delay time has expired. Any variations in the HEGO sensor output before an exhaust gas transport period of time has expired is, by definition, not considered to be a true result caused by the new fuel level commanded. If the air/fuel ratio has not responded by switching between rich to lean at the end of the exhaust gas transport delay, the fuel control will then progressively increase the base fuel offset at a predetermined ramping rate until the desired switch has occurred. Subsequently, if the HEGO sensor indicates a correct air/fuel change between one and two times the exhaust gas transport time, this event indicating that the exhaust gas transport time is incorrect. This is because a new/air fuel mixture as commanded by the fuel control processor at the expiration of the first transport period of time would not reach the HEGO sensor until after a second transport time delay. In this case the feedback controller would calculate the fuel commanded to one previous transport time period delay, and which would be at the original fuel command level. As this situation does not indicate a new fuel command level, the transport time delay would be updated to this new indicated transport time delay. In the event that the HEGO sensor indicates a correct air/fuel switch has occurred in a time span greater than two times a operating exhaust gas transport time, (see FIG. 5) the control system will calculate back in time one transport delay. The resulting calculation would result in a greater than previous - fueling offset. This new value (or corrected value) would be used for the next commanded offset. This periodic re-learning function will have the additional benefit of cleaning the chemical reactants which have been more securely electrochemically bonded to an active site on the catalyst by causing a greater than normal air/fuel shift by causing periodic larger shifts of commanded fuel offsets as well as serving to minimize fluctuations and magnitude of the rich step value and lean step value.

In accordance with a further feature of the invention, a second HEGO sensor is located downstream of a catalytic converter positioned in the exhaust system and would be interrogated for a sensor output voltage. This functional capability would be enabled to balance the air/fuel ratio over a longer time base. If the short term fuel control is not perfectly balanced (which is a common occurrence) the chemical reactants in the exhaust stream will cause a loading of the catalyst either toward rich or lean realm depending on the net imbalance. In the event where there is a net rich imbalance there will be a voltage increase on this second HEGO sensor. In this event the controller will cause an increase of authority on the lean side of fuel control. This can be effected by an increase in fuel offset amount or in an increase in calculated transport delay. Either or both of these changes can be used to trim the overall air/fuel balance to a more perfect level.

In accordance with another feature of the invention, the initial enrichment rate is calculated by forming the sum of a base fuel flow rate based on a corrected mass air charge value and also corrected for fuel and hardware errors, and adding the previously determined rich or lean offset values. Whereas the initial lean or rich fuel flow rate is calculated by utilizing the base flow rate as above and subtracting a lean offset value from this base flow value or adding a rich offset value. Both the rich and the lean offsets from the base flow rate are independent values which are varied under adaptive control as noted above (see FIG. 3) and, in addition, the initial base flow rate is increased whenever actual flow rate exceeds an upper rich limit, and the initial base flow rate is reduced whenever the actual flow rate is reduced below a lower lean limit as in FIG. 6. This process is used to maintain stability.

According to still another feature of the invention, the control system will reduce the magnitude of the initial rich rate and the initial lean rate by a small value whenever a transition through stoichiometry occurs exactly as predicted. In this way, the control system is able to reduce the magnitude of the excursions about stoichiometry, thereby minimizing larger than necessary excursions which will also minimize emissions by maintaining tight fuel control about stoichiometry.

According to still another feature of the invention, the control system will reduce the exhaust gas transport delay time progressively although slowly. In this way the control system will again minimize the time necessary for a complete limit cycle and therefore minimize tailpipe emissions.

According to still another feature of the invention, the control system automatically resets itself to predetermined initial states for both rich and lean conditions and/or transport delay time values whenever these control values fall outside normal realms or the non-volatile memory checksums indicate a memory corruption may have occurred such as may be caused by complete power loss. In this way , the control system is able to adapt to unusual or unexpected circumstances, and to automatically reset itself to more robust conditions from which further adaptation may proceed whenever the unusual conditions are discontinued.

BRIEF DESCRIPTION OF THE DRAWINGS

Reference will now be had to the attached drawings, when read in combination with the following specification, wherein like reference numerals refer to like parts throughout the several views, and in which.

DETAILED DESCRIPTION OF THE PREFERRED EMBODIMENTS

Figure 1:
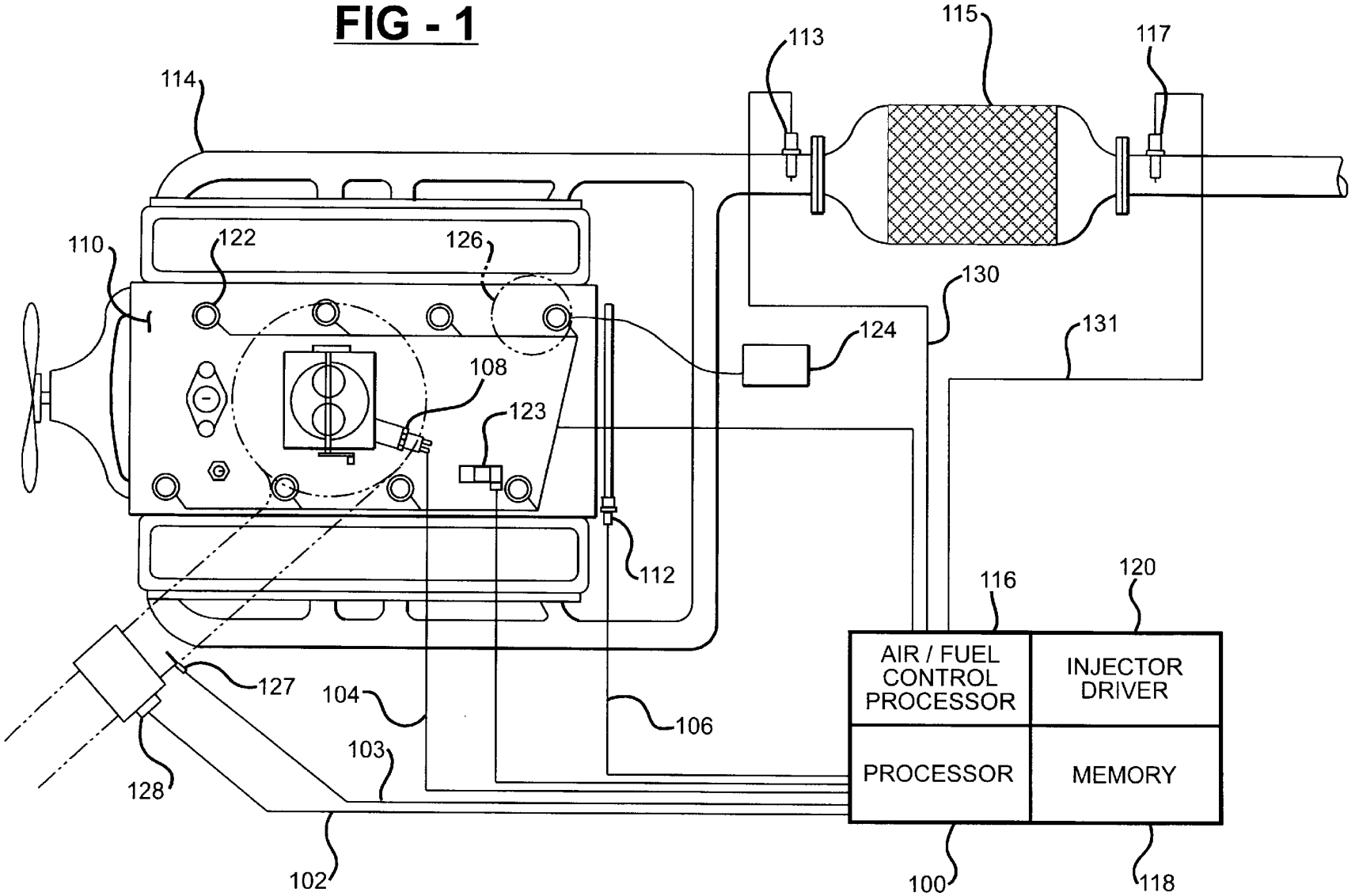
FIG. 1 is a schematic block diagram of an internal combustion engine and an electronic engine control system which embodies the invention.

Referring to FIG. 1 of the drawings, a typical fuel control system of the type which may be adapted to use the principles of the invention is illustrated. A closed-loop controller 100 has three signal inputs 102, 104, and 106. An air intake manifold vacuum sensor 108 generates a voltage proportional to vacuum strength in an air intake manifold 110. A tachometer 112 generates a voltage proportional to the engine speed. A hot exhaust gas oxygen sensor 113 (HEGO) generates a voltage proportional to the concentration of oxygen in an exhaust manifold 114, and a catalytic converter 115 reduces undesirable by-products of combustion. The oxygen sensor 113 is of a known type typically consisting of a hollow zirconium oxide ($ZrO_2$). shell, the inside of which is exposed to atmosphere.

The controller 100 consists of three modules: closed-loop air/fuel control processor 116, a non-volatile memory module 118, and a cylinder synchronous fueling system 120. The IHEGO sensor 113 is connected to the air/fuel control processor 116 via a communication line 130. These modules function together to produce control signals which are applied to actuate fuel injectors indicated generally at 122. Each of the fuel injectors 122 is operatively connected to a fuel pump 124 and physically integrated with an internal combustion engine depicted within the dotted circle 126. The fuel injectors 122 are of conventional design and are positioned to inject fuel into their associated cylinder in precise quantities.

These modules are preferably implemented by available integrated circuit micro-controller and memory devices operating under stored program control. Suitable micro-controllers are available from a variety of sources and include the members of the Motorola 6800 family of devices which are described in derail in Motorola's Micro-controller and Micro-processor families. Volume 1 (1988). published by Motorola. Inc. Micro-controller Division, Oak Hill, Tex. The fuel injection signals are timed by processing event signals from one or more sensors (as illustrated by the tachometer 112 in FIG. 1) which may be applied to the micro-controller as interrupt signals. These signals include signals which indicate crankshaft position, commonly called PIPS (Piston Interrupt Signals), which are typically applied to the microprocessor's interrupt terminal (not shown) to execute interrupt handling routines which perform time critical operations under the control of variable stored in memory. By accumulating the interrupt signals, numerical values indicating crankshaft rotation can be made available to the adaptive fuel control system to be discussed.

Prior Fuel Control Methods

Figure 2:
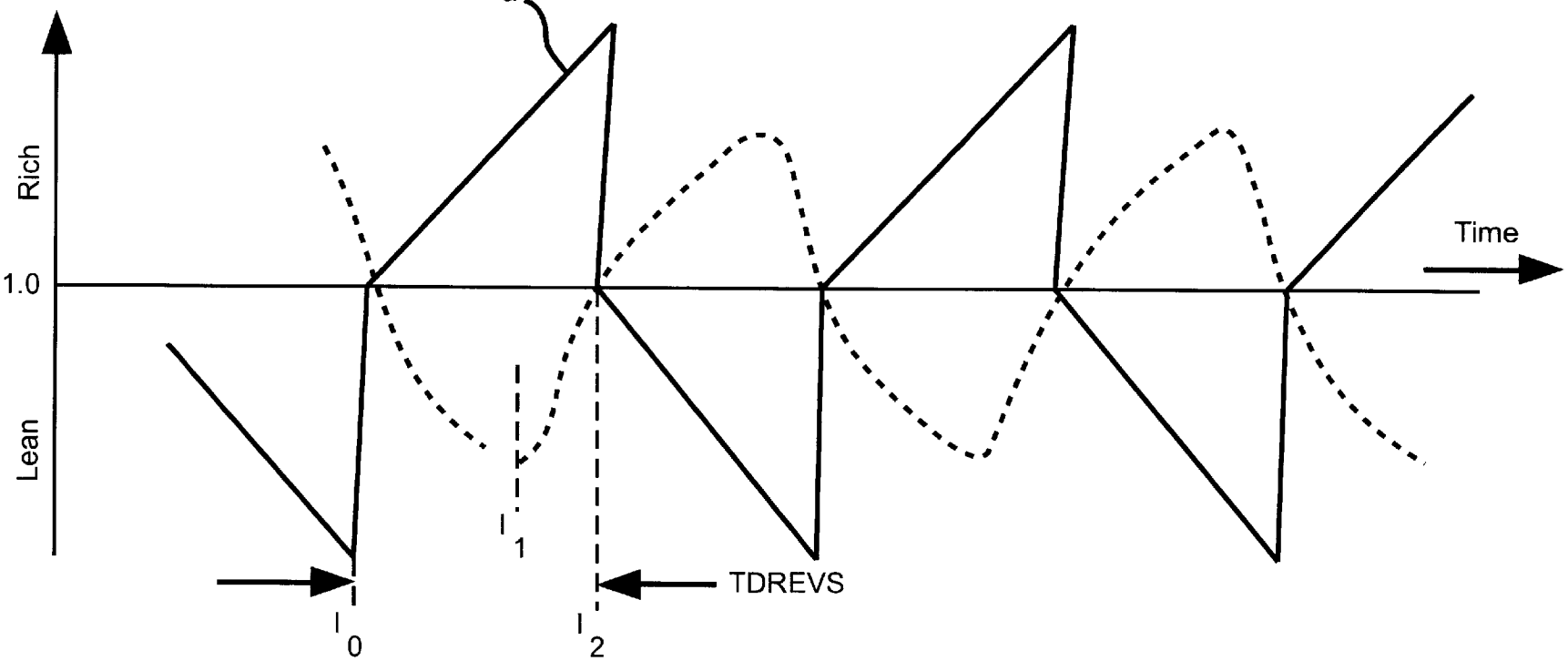
FIG - 2 PRIOR ART
FIG. 2 is a graph showing the relationship between various signal wave forms in a known fuel control system and the resulting fuel control.

A known method for controlling fuel delivery is illustrated in FIG. 2 and was described by D. R. Hamburg and M. A. Schulman in SAE Paper 800826. The controller output signal, shown by the solid line wave shape in line (a), is formed from the sum of an integral, saw tooth component and a term directly proportional to the two-level sensor output signal, the control signal amplitude indicated by the solid-line wave form is proportional to the amount of fuel injected, typically by controlling the pulse width of the injection signals delivered to the injectors 122. The dotted-line wave shape indicates the oxygen level being sensed by the HEGO sensor 113. Each time the exhaust sensor 113 determines that the combustion products indicate stoichiometry, the fuel injectors are commanded to immediately "jump back" to a predetermined nominal air/fuel mixture which is hoped to be at or near stoichiometry. Thereafter, the now rate is gradually altered in a direction opposite to its prior direction of change until the exhaust gas sensor determines that stoichiometry has again been crossed. The "jump back" and nominal levels for the control system are predetermined and are stored in a nonvolatile memory.

As seen in FIG. 2, the peaks of the wave shape illustrating exhaust oxygen level are delayed from the corresponding peaks of the fuel-intake wave shape. This peak-to-peak delay results from the physical transport delays experienced by the air and fuel as it passes through the engine's intake manifold, undergoes combustion in the cylinders, and passes partially through the exhaust system to the position of the sensor. Thus, at time t0, when the exhaust sensor detects a transition from too little oxygen (a "rich" air/fuel ratio) to too much oxygen (a "lean" air/fuel ratio) at the exhaust sensor 113, the previously decreasing fuel flow rate is "jumped back" to a nominal level and then gradually increased. This reversal of the rate of change of the mixture is not manifested at the exhaust sensor until time t1, which is delayed from time t0 by the physical transport delay experienced by the combustion products in passing through the engine and the exhaust system.

The control system of FIG. 2 causes the air/fuel ratio to "hunt" about stoichiometry, and the period of each cycle is delayed considerably beyond the duration of the physical transport delay. Note that, beginning at time t0 when the effects of the increasing fuel rate are detectable at the sensor, the combustion products seen at the sensor continue to indicate a lean condition until time t2 when the exhaust oxygen level again indicates a rich rather than lean condition. As seen in line (a), by the time t2 when the fuel flow rate is switched to a decreasing slope, the intake mixture has grown excessively rich. The control mechanism depicted in line (a) accordingly allows the intake mixture to deviate substantially from stoichiometry during the prolonged effective closed-loop control delay periods as discussed later, the effective transport delay may be represented numerically by the count of PIPS pulses which occurred as the crankshaft turns between times t0 and t2 to yield the value TDREVS.

The control system illustrated in FIG. 2 fails to account for differences in rich and lean operation. For example, as shown in FIG. 2, if, starting at or near the stoichiometric point, additional fuel is ramped in, at some point along this ramp, the correct amount of fuel will be added such that the oxygen sensor can identify the transition to the rich side of stoichiometry. However additional fuel continues to be ramped in until the oxygen sensor actually sees the transaction. This additional fuel is unnecessarily added. The same analysis is applied to the lean ramping, only in the opposite direction. The peak-to-peak values determine the minimum/maximum excursion of the fuel rate at a set TDREVS. Adding and deleting fuel causes a cyclical variation in engine power and reduces fuel economy. During normal operation of an internal combustion engine, this excessive peak-to-peak value is the main cause of regulated vehicle emissions. This can also result in a driveability parameter called surge if the total excursion is significant. Additionally, the control system in FIG. 2 fails to account for the difference in rich-to-lean versus lean-to-rich control errors.

The control system illustrated in FIG. 2 also lacks the capacity to correct for errors or inaccuracies in operation. For instance, if the variations in components from engine to engine, and aging of sensors, fuel injectors, intake system deposits, and other components produce variations in performance. Such variations consequently require alteration of the fuel control strategy. The system illustrated in FIG. 2 utilizes a fixed control strategy. The strategy is capable of responding only to the current output of the HEGO sensor 113, and is incapable of correcting for past detected inaccuracies in the delivery of fuel.

The present invention employs a different strategy for controlling the fuel level by rapidly achieving stoichiometry while preserving the desired repetitive perturbations between rich and lean conditions to improve the conversion efficiency of the catalytic converter. In accordance with the invention, when a shift between the rich and lean levels is detected by the exhaust gas oxygen sensor, the fuel delivery rate is immediately moved to an initial step value which should be sufficient, without further change, to bring the exhaust mixture back to stoichiometry and also slightly rich again within a predicted step interval. If stoichiometry is not achieved or passed within the predicted interval, the fuel delivery rate is progressively adjusted during the current cycle to insure that stoichiometry will eventually be achieved. If the actual delay in effecting a switch in the HEGO sensor exceeds a predetermined duration also known as a Transport Delay REVolutionS, but not more than two times the TDREVS interval, then the total interval is back calculated to determine the new desired TDREVS. This value will be the total time required to effect a switch. If the delay in effecting a switch is greater than two times the used TDREVS, then the fuel level required for a switch is back calculated one TDREVS period of time to determine a new fuel control level for use in the next cycle which is the fuel level commanded at the level—one TDREVS period of time before the switch occurred. If the determined delivery rate exceeds a predetermined upper rich limit above the normal commanded fuel delivery rate, the average delivery rate is increased by increasing both the initial rich rate and the initial lean rate in total value; whereas, in the event the fuel delivery rate falls below a predetermined lean limit, the initial rich and lean rates are both decreased to the new value. The wave form which appears in FIG. 5 of the drawings, as will be further described, illustrates the manner in which the initial rich or lean steps are adaptively varied as contemplated by the invention.

Figure 5:
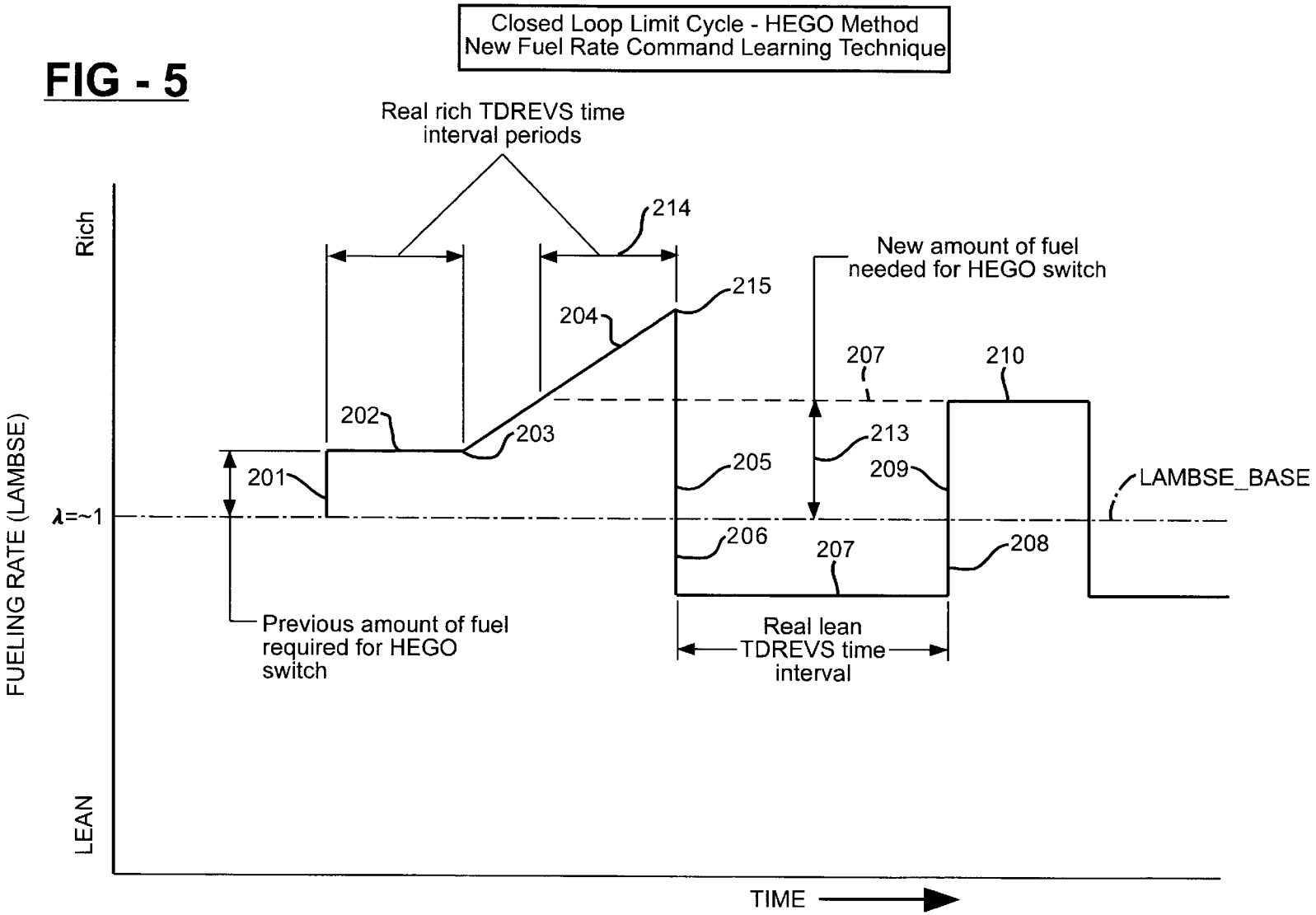
FIG. 5 is a graph showing the relationship of the embodied invention while learning a correct LAMBSE offset also known as a RS (rich step offset) or LS (lean step offset) variable.

Referring again to FIG. 1 and also to FIG. 5, when the oxygen sensor 113 detects a change in operation from rich to lean, the processor 116 commands the fuel system to immediately make a step to a rich initial rate of delivery as indicated at 201. The initial rich rate is set to the sum of a base value LAMBSE_BASE plus a rich step offset value RS. This initial rich rate is maintained as seen at 202 for a predetermined length of time, designated as RTDREVS (Rich Transport Delay in REVolutionS), which represents the predicted duration of the lean indication from the HEGO sensor. If the HEGO sensor 113 fails to indicate a transition to a rich indication within the predicted lean exhaust interval RTDREVS at 203, the processor 116 then begins to progressively increase the fuel delivery rate as indicated at 204. At 215, when the exhaust sensor indicates that the exhaust oxygen sensor voltage has been increased to indicate a rich condition, the processor 116 immediately steps the control wave form to LAMBSE_BASE 205 plus a lean initial step value 206 LAMBSE_BASE−LS, where LS 206 is the Lean Step offset value. Simultaneously, a corrected rich step rate or value (RS 212) is calculated. At the same time, the processor 116 increases the value of RS 212 so that, on the next cycle, stoichiometry may be more rapidly achieved. This lean fuel output is maintained for a second predetermined length of time, herein designated as LTDREVS (Lean-Transport Delay in REVolutionS), as seen at 207. If the exhaust sensor has not indicated a lean condition by the expiration of the LTDREVS interval, the processor 116 can begin to progressively reduce the fuel delivery rate as it has with the rich control side. At step 208, when the exhaust sensor detects a lean condition, the processor 116 abruptly alters the fuel delivery rate to LAMBSE_BASE+RS, however, since RS 212 was increased on the last cycle by back calculating the correct necessary fuel level, the rich rate seen at 210 is higher that the rich rate at 202 on the prior cycle. The cycle is completed by the processor responding to the expiration of the lean step duration by abruptly increasing the fuel delivery rate at 209 to the corrected RS 212.

As discussed in more detail below, the adaptive control method contemplated by the invention also provides a mechanism for adjusting the duration of the predicted intervals RTDREVS and LTDREVS as described in FIG. 4, for adjusting the value of the base value LAMBSE_BASE in FIG. 6, and for resetting the adaptive parameters to initial values when the stoichiometry is achieved before the expiration of a predicted step interval. The adaptive control method also provides a control mechanism for decreasing the magnitude of both the initial rate, RS and LS, and the time for which these rates are maintained. RTDREVS and LTDREVS, if the HEGO sensor switches on schedule. This functionality allows the controller to decrease both the length and magnitude of the excursions about stoichiometry.

Before processing begins, the closed loop control processor 116 first initializes several process variables, including: LAMBSE_RS, LAMSE_RRS, LAMBSE_LS, LAMBSE_LLS, INIT_RS, INIT_RRS, INIT_LS, INIT_LLS, INIT_RTDREVS, INIT_LTDREVS, LAMBSE_BASE_RST, RTDREVS, LTDREVS, RAMP_RATE, LAMBSE_MAX. and LAMBSE_MIN. RS, RRS, LS and LLS are variables which represent the rich step and lean step values which operate as positive and negative offsets, respectively, from the base value LAMBSE_BASE. RS and LS are initially set to the values INIT_RS and INIT_LS respectively which are selected based on the predicted performance of the engine. INIT_RTDREVS and INIT_LTDREVS are initial values respectively for RTDREVS and LTDREVS, the predicted rich transport delay and lean transport delay periods respectively. For simplicity, the processing of the terms LS and LLS and very similar except for the magnitude of the initial step away from LAMBSE_BASE, as are RS and RRS in a opposite direction of fuel level commanded.

The initial value for LAMBSE_BASE is set to a nominal value of 1.0.

As discussed below, the fuel control signal LAMBSE deviates from LAMBSE_BASE by the offset RS or the offset LS, plus an additional time-based fuel ramp modification when the offset RS or LS alone is not able to achieve stoichiometry within the predicted duration. LAMBSE is cyclically altered by the closed loop control to vary the air/fuel ratio above and below stoichiometry, with a LAMBSE value of 1.0 corresponding to a desired air/fuel ratio of about stoichiometry. LAMBSE_BASE is initially set to a nominal value of 1.0 and, as will be seen, may thereafter be adaptively varied to correct LAMBSE for variation and aging of parts or fuel composition within the engine.

RS and LS are variables which indicate the times for which respectively the rich step (RS) and lean step (LS) are maintained. RTDREVS and LTDREVS represent the predicted transit time for a switch to a rich and lean flow rate respectively to cause the exhaust oxygen level to reach stoichiometry. For example, when the HEGO sensor 113 indicates the onset of a lean condition, the fuel control processor 116 seen in FIG. 1 responds by switching the LAMBSE signal to an initial rich flow rate (LAMBSE_BASE+RS) which will be maintained for at least the predicted transit delay indicated by RTDREVS.

If the HEGO sensor 113 does not detect a reduction in oxygen level indicating a rich condition within the duration defined by RTDREVS, then the LAMBSE value is increased even further at a rate determined by RAMP_RATE. Similarly, the processor 116 has reduced the fuel delivery rate (to LAMBSE_BASE-LS) for a duration which exceeds LTDREVS, LAMBSE is decreased even further at RAMP_RATE until the sensor responds by detecting a lean condition.

Whenever stoichiometry is reached in an interval that exceeds the predicted interval RTDREVS, the actual duration of RS is compared with a threshold value RSMAX. If the duration RS was not excessive, the value of RTDREVS is used as in blocks 28, and 30 (see FIG. 7), if RS was greater than RSTMAX then the value of RS is increased as is the value of LS as described in FIG. 6. The control variables LTDREVS and LST are adaptively varied in the same way in response to excessive excursions of the value LST beyond LTDREVS and LSTMAX.

The optimum values of the adaptive variables RS, LS, RTDREVS. and LTDREVS, as well as the parameters RSTMAX, LSTMAX, and RAMP_RATE, differs substantially at different engine speeds and loads. Accordingly, these variables are preferably stored in a lookup table indexed by speed, load, and temperature variables. Although these values are referred to in this specification as if they were single values, it should be understood that each such value is advantageously selected from a three-dimensional array of values indexed by the combination of a numerical speed value (obtained from sensor 112 via input 106 seen in FIG. 1) and numerical engine load value (obtained from sensor 108 or 128 via input wire), and temperature values obtained by the ECT and ACT 127 sensors. These indexed lookup tables are preferably implemented using a portion of the non-volatile memory (KAM or "Keep Alive Memory") which retains the adaptively learned values when the engine is turned off. Whenever the LAMBSE signal makes an excursion outside a predetermined acceptable range, bounded by an upper limit LAMBSE_MAX and a lower limit LAMBSE_MIN. the base value LAMBSE_BASE is modified in the same direction to effectively shift the average value of the LAMBSE value toward rich, or toward lean, as required to more rapidly achieve stoichiometry. In this way, the adaptive control compensates for conditions, such as changing fuel types or engine conditions, which may require a change in the average air/fuel ratio for best performance.

Figure 3:
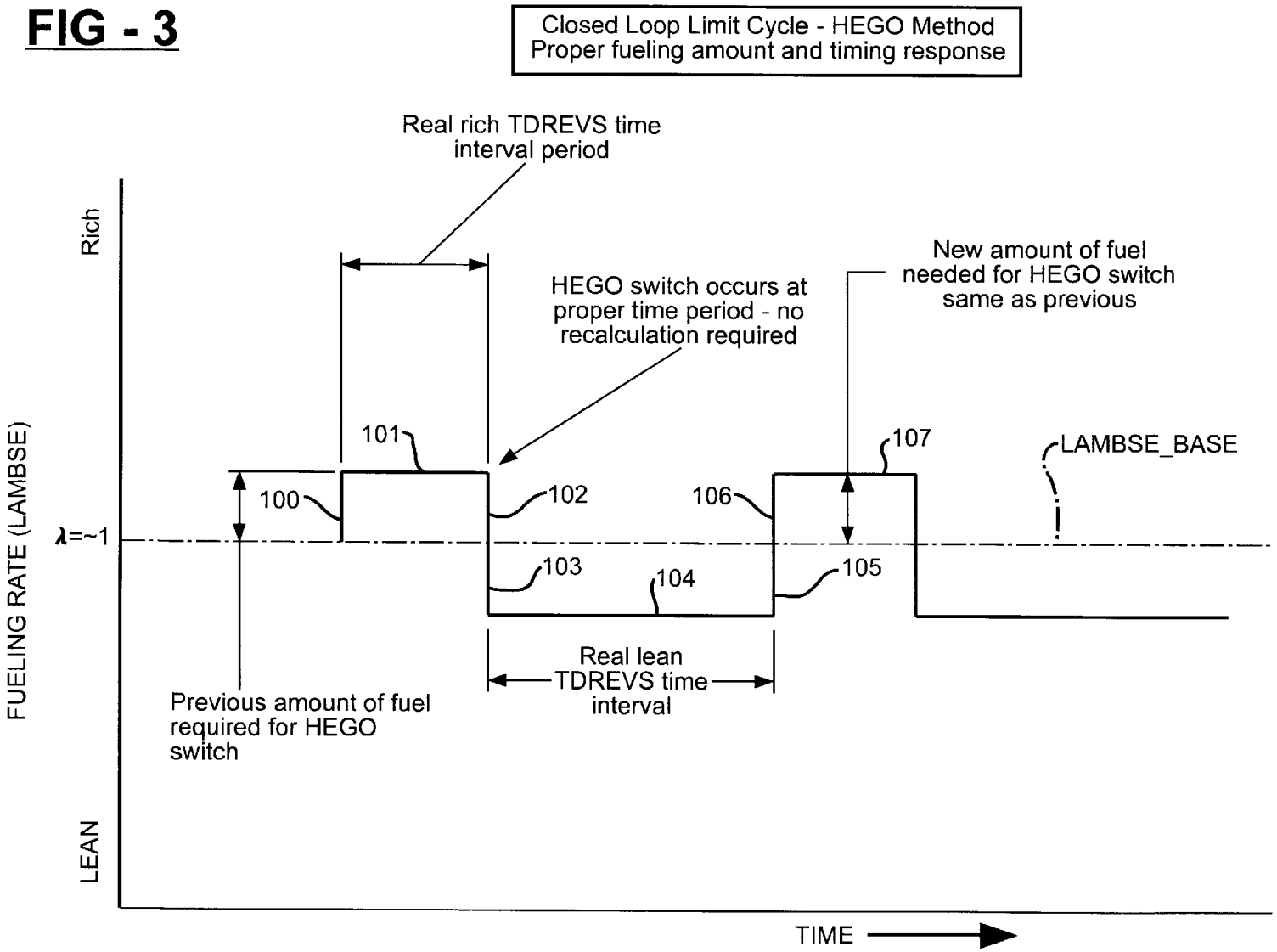
FIG. 3 is a graph showing the operation of a preferred embodiment of the present invention while operating without corrections.
Figure 4:
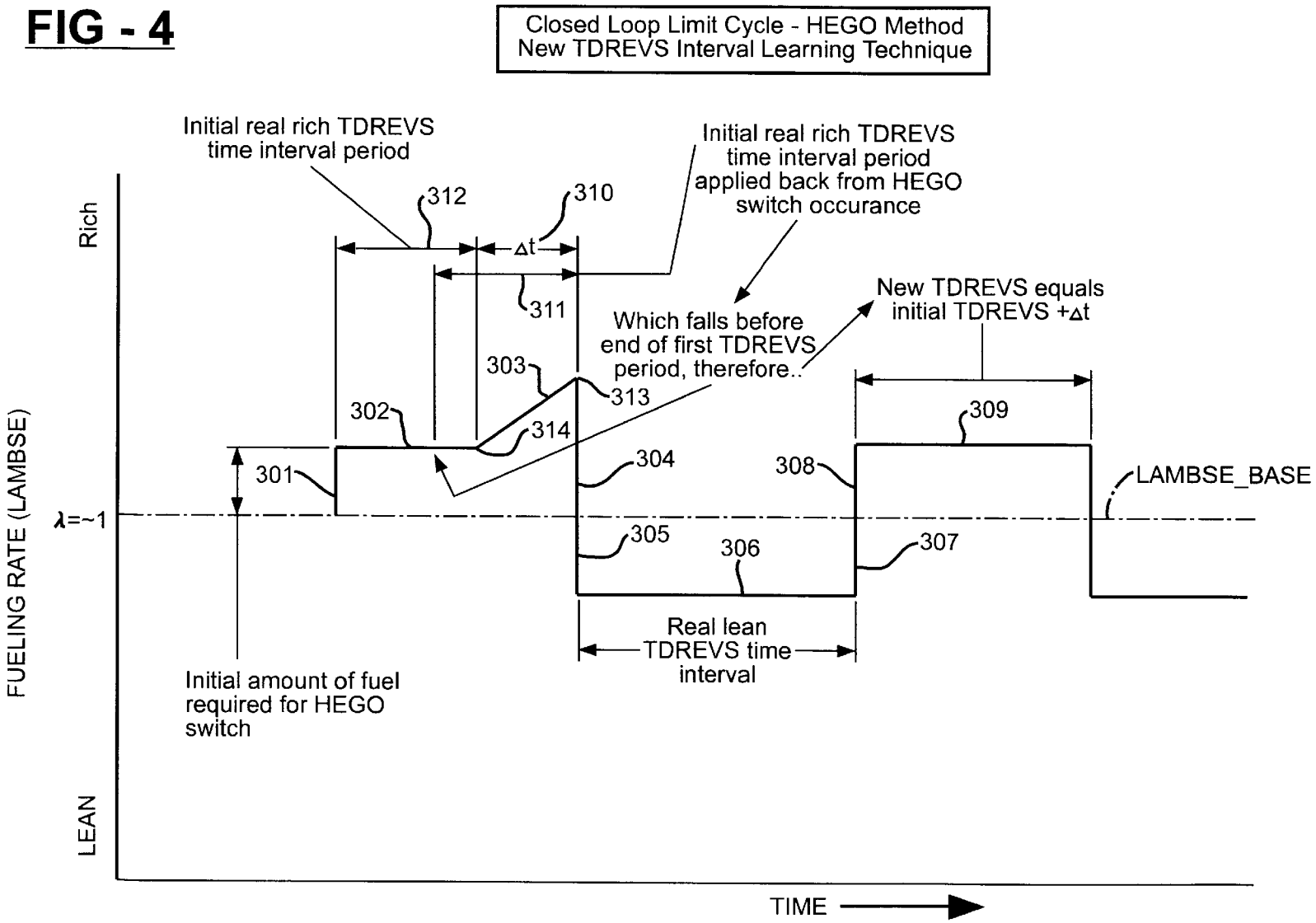
FIG. 4 is a graph showing the relationships of the embodied invention while learning the correct TDREVS variable.
Figure 6:
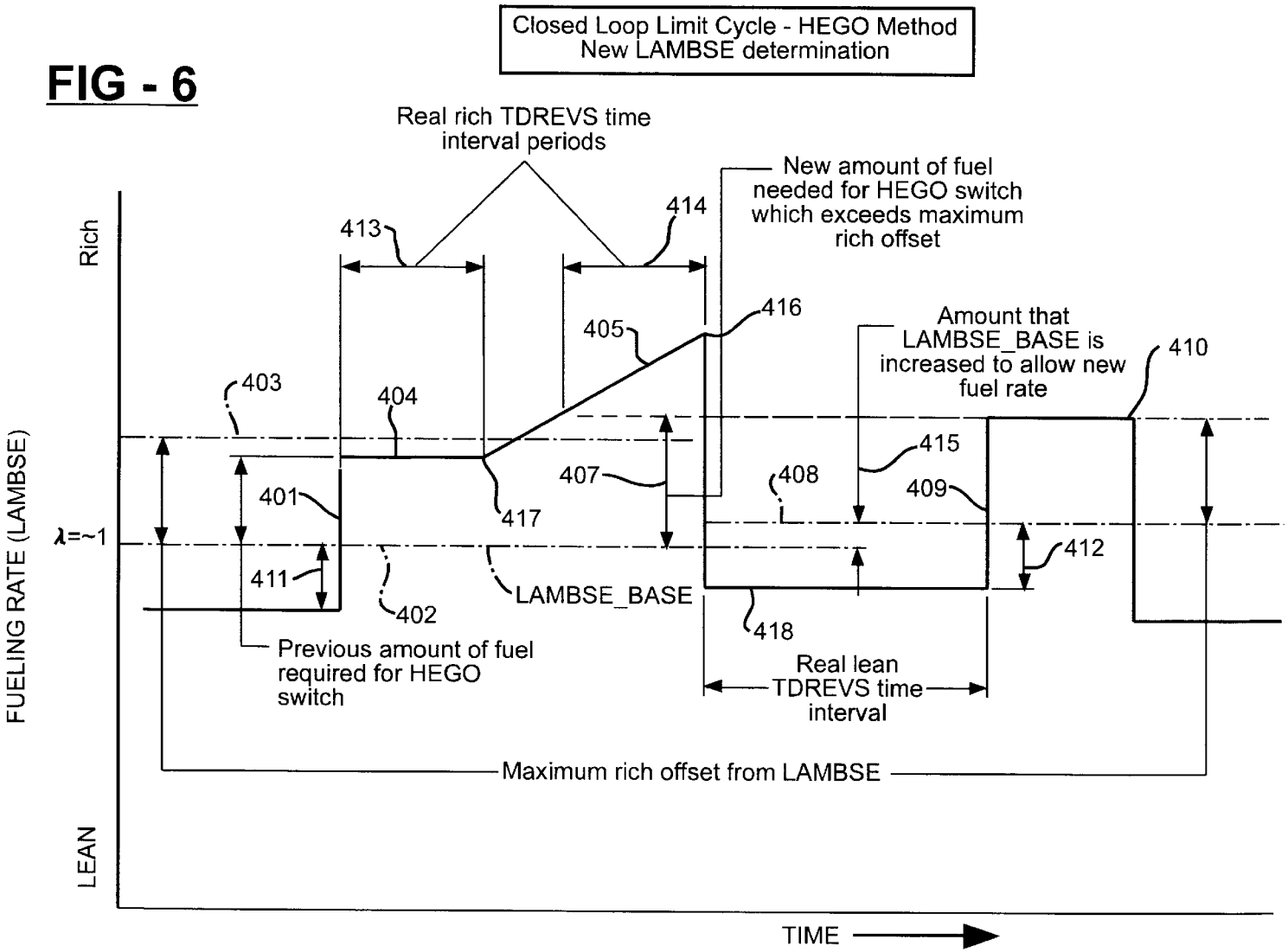
FIG. 6 is a graph showing the relationship of the embodied invention while learning the correct LAMBSE_BASE offset.

Summarizing the additional graphical representations FIGS. 3, 4, and 6, and referring first to FIG. 3, the operation of the preferred embodiment of the present invention is illustrated while operating without corrections. Specifically, step 100 illustrates an increase in fuel delivery to a real rich TDREVS time interval period 101. The HEGO sensor 113 switch occurs at time period 102 with no recalculation being required. A decrease of fuel delivery at 103 to a lean transport delay in revolutions interval occurs at 104. Upon expiration of the lean interval 104, the fuel delivery rate is increased at 105 to lambse base 1.0 and further at 106 to a level 107 at which a new amount of fuel is needed for the HEGO sensor 113 to switch the same as previously.

Referring to FIG. 4, a graph illustrating the relationships of the invention while learning the correct TDREVS variable is illustrated. As with FIG. 5, FIG. 4 plots the fuel rate increments and decrements about a stoichemtric level 1.0 and as a function of time. The initial amount of fuel required for the HEGO sensor 113 to switch is indicated at 301 to predetermined length of time, designated at TDREVS 302. At point 314, expiration of the rich step duration 302 results in an increase of fuel delivery along ramp 303 to indication of a rich condition 313. The change in time corresponding to the ramping increase 303 to rich condition 313 is illustrated at 310. At 311 is illustrated the time elapse between a selected value before the end of the first TDREVS 302 to the indication of a rich condition 313 and is quantified as the initial real rich TDREVS time interval period applied back from the HEGO switch occurrence. The fuel delivery is decreased at 304 to the stoichemetric level and is then further decreased at 305 to a real lean TDREVS time interval 306. After elapsing of the interval 306, the fuel delivery rate is increased at 307 to the stoichemetric level and a further amount 308 to a new TDREVS level 309 which equals the initial TDREVS 302 plus the time elapse 310.

Referring to FIG. 6, a graphical representation of the relationship of the invention while learning the correct LAMBSE_BASE offset is shown.

Figure 7A:
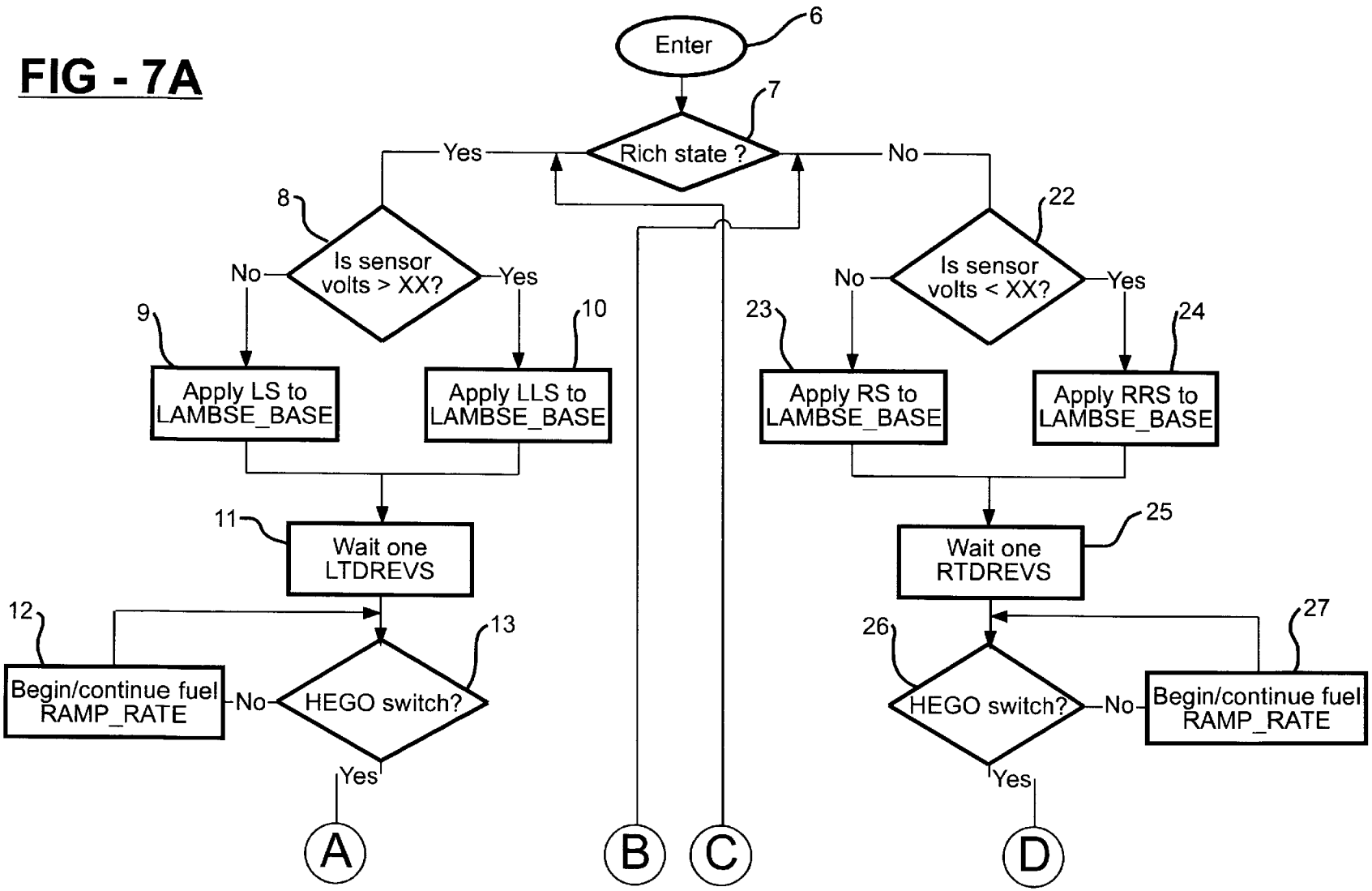
FIG. 7 is a logic flowchart depicting the operation of a preferred embodiment of the invention.
Figure 7B:
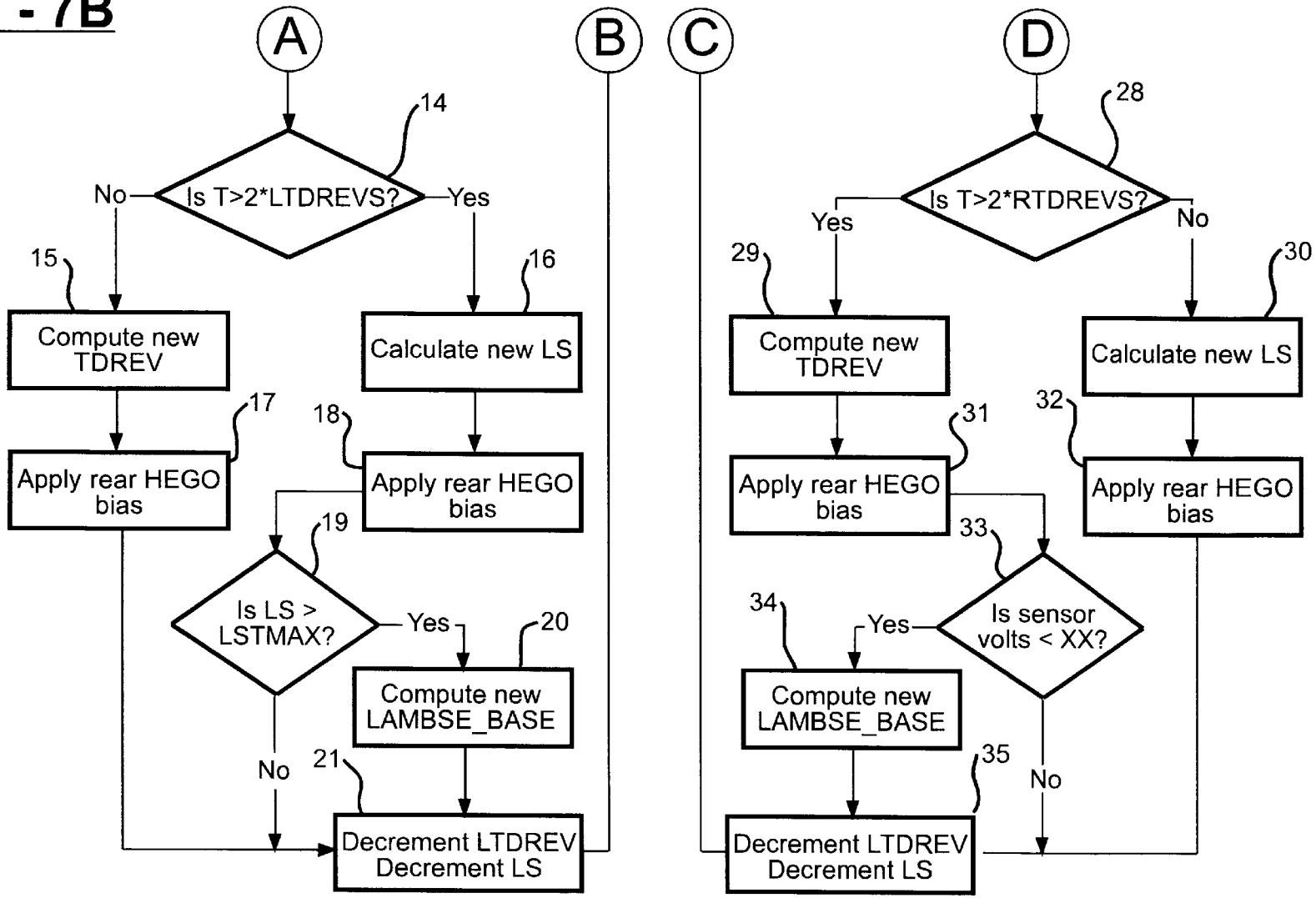

The flowchart seen in FIG. 7 illustrates the details of a preferred method for implementing the functionality described above by means of a control processor of the type indicated at 116 in FIG. 1. After initialization, previously described, a closed-loop fuel control algorithm is repetitively executed as indicated in FIG. 3 entering at block 6.

As noted earlier, the concentration of oxygen in the exhaust gas is detected by the heated exhaust gas oxygen (HEGO) sensor 113, which may be the zirconium oxide (ZrO2) type well known in the art. The HEGO sensor 113 generates a voltage proportional to the concentration of oxygen in the exhaust manifold 114 which may advantageously be converted into a digital quantity by an analog-to-digital converter within the micro-controller used to implement the control. The oxygen level value is compared to a predetermined threshold values which, for the particular HEGO sensor used, represents the sensor voltage output at stoichiometry. This comparison in this invention produces a four-state (rich, very rich or lean and very lean) values for HEGO output which is tested at blocks 8 and 22, in FIG. 7 as described below. The HEGO is also used as a binary rich and lean signal at blocks 7, 13, and 26.

For the following description, the four allowable oxygen sensor output states: rich, very rich, lean and very lean would correspond to a initial rich step with values of RS for rich, RRS for very rich, LS for a lean step, and LLS for a very lean step as the initial proportional steps. These values are determined at blocks 8 and 22 with the proper result going to blocks 9, 10, 23, and 24. The following description will only use RS for rich steps and LS for lean steps to simplify the description although LLS and RRS would be used if the oxygen sensor output voltage was sufficiently low or high as tested at blocks 8 and 22.

If the HEGO value test at 7 indicates excess oxygen and a lean mixture, LAMBSE is set to LAMBSE_BASE+RS at 10. If the value indicates a rich exhaust mixture (i.e., insufficient oxygen), LAMBSE is set to LAMBSE_BASE–LS at 9. The controller's method of responding to either a rich or a lean mixture is similar, as plainly seen by the symmetry between lean condition processing at the left and rich condition processing at the right in FIG. 7. Accordingly, the operation of the system's response to a lean mixture will be described in the text that follows with the understanding that the method for responding to a rich mixture is essentially the same.

Once LAMBSE is set at 23 or 24, to the base value LAMBSE_BASE plus the rich step RS offset, the controller 100 enters a loop including 25, 26, and 27. The HEGO value is checked at 26 to see if it has switched to indicate a rich exhaust. Note that the fuel ramping is continually incremented by the engine rotation signals received via line 106 as the crankshaft rotates to provide an increased value which reflects the amount of crankshaft rotation which has occurred since the rich step began. If the HEGO value switches prematurely, before one RTDREVS has expired, then the controller can flag for a possible problem. A HEGO switch should not occur before one TDREVS has elapsed because the gasses from the combustion process cannot reach the oxygen sensor before the period of time TDREVS. Therefore, the processor will not act on the erroneous information supplied by the HEGO before one TDREVS time period. By maintaining RS for at least RTDREVS the controller ignores premature switch in the HEGO sensor which may be representative of the exhaust output of a single cylinder which has either an inaccurate air/fuel mixture caused by physical problems or has ignited prematurely or incorrectly. If the HEGO does not "see" a proper switch just after one TDREVS then the fuel will begin ramping up as in block 27. Then the controller loops back to the test at 26 until a HEGO switch occurs.

When the HEGO switch occurs, the period of time which has elapsed is calculated. The four possible time frames include:

Where measured TDREVS is less than 1 times used TDREVS, here the system will not modify the fuel control because of the reasons described above.

Where measured TDREVS is equal to or just greater than 1 which would cause a correct switch to occur to the lean computation logic at block 6 and which is graphically described in FIG. 3. This is the normal operation of the invention.

Where TDREVS is less than two time periods and greater than approximately one, a new TDREVS is calculated as in block 30 and graphically described in FIG. 4. Here, at the point of a HEGO switch the RS or LS value is back calculated one TDREVS period of time, if the back calculated value of RS or LS is the same as the initial RS or LS value, than the RS or LS value is found to be initially correct. In this case the TDREVS value is found to be in error, and a new value is found to be the total time required to effect the switch.

The forth possibility is where a TDREVS greater than two time periods. This is where a new rich step RS or LS as in block 29 is back calculated. This is graphically described in FIG. 6 where at the point of a HEGO switch, the new RS or LS is found to be the RS or LS value commanded one TDREVS period of time before the HEGO switch occurred.

At the points in the logic block of 17, 18, 31 and 32 of FIG. 7, the suitable use for the second HEGO(s) 117 found in the exhaust gas stream as shown in FIG. 1 is utilized and is connected to the air/fuel control processor 116 via communication line 131. Here an additional HEGO 117 which is normally included in the exhaust system for the OBDII (On Board Diagnostics—level 2) logic purpose can be utilized to optimize the Catalyst 115 for regulated emissions, specifically Nitric Oxides (NOx) but to a lower level Hydrocarbons (HC's) and Carbon Monoxide (CO).

The rear HEGO also is given a suitable target voltage with which an overall fuel control Bias can be imposed upon the commanded fuel. For this example, an overall reduction in NOx is considered to be desired. A voltage of 0.76 volts may be the desired voltage target in this case although a different D voltage may be useful based on engine speed and cylinder air charge. Here, quite simply, a process which uses the current HEGO based feedback fuel control as is currently utilized as in FIG. 2 would be adequate. Because the timing of fuel control when processing the signal from the rear sensor is not relatively fast, a very simple feedback control is adequate. A further adaptation of this invention utilizing the proposed process for rear HEGO control is possible if improved precision is desired. Here, a feedback process in which perturbations about the target voltage of the second HEGO would bias the overall fuel control to a level which would optimize the catalytic activity is created.

At logic blocks 33 and 19, a check in involved which will insure that too much fuel control is not invoked or that any great errors are quickly controlled. This logic is graphically shown with FIG. 6.

In the previous description as shown when system operation begins, adaptation increase or decrease as needed to match actual operating conditions. Learning the adaptive parameters in this fashion helps to insure a balanced variation of LAMBSE about stoichiometry and thus enhance the operation of the catalytic converter by balancing the number of active sites in the converter on which catalytic conversion takes place for both rich and lean operations.

It is to be understood that the specific mechanisms and techniques which have been described are merely illustrative of on application of the principle of the invention. Numerous modifications may be made to the methods and apparatus described without departing from the true spirit and scope of the invention.

I claim:

1. A method of controlling a fuel delivery rate at which fuel is supplied to a fuel intake of an internal combustion engine, said method comprising the steps of:

measuring a voltage level from an exhaust gas oxygen sensor located in communication with combustion gases exhausted by the engine so as to produce a very rich exhaust indication when said voltage level is measured in a first highest voltage range, a rich exhaust indication when said voltage level is measured in a second voltage range lower than said first highest voltage range, a lean exhaust indication when said voltage level is measured in a third voltage range lower than said first and second voltage ranges, and a very lean exhaust indication when said voltage level is measured in a fourth voltage range lower than said first, second and third voltage ranges;

responding to an onset of each lean exhaust indication by abruptly increasing said fuel delivery rate to a predetermined rich step value and thereafter maintaining said delivery rate at said rich step value until onset of a rich exhaust indication or until a predetermined rich step duration expires;

responding to an expiration of said rich step duration by increasing said fuel delivery rate in a progressive manner from said predetermined rich step value until a rich exhaust indication is produced;

responding to an onset of each rich exhaust indication by abruptly decreasing said fuel delivery rate to a predetermined lean step value as well as simultaneously calculating a corrected rich step value which is greater than said initial rich step value and thereafter maintaining said delivery rate at said lean step value until onset of a lean exhaust indication or until a predetermined lean step duration expires;

responding to the expiration of said lean step duration by decreasing said delivery rate in a progressive manner from said predetermined lean step value until a lean exhaust indication is produced; and responding to onset of each lean exhaust indication by abruptly increasing said fuel delivery rate to said corrected rich step value;

whereby fluctuations and magnitude of said rich step value and said lean step value are minimized.

2. The method as set forth in claim 1, comprising the further step of increasing said rich step value whenever the duration of a lean indication exceeds a first rich interval and a second rich interval.

3. The method as set forth in claim 2, comprising the further step of increasing said lean step value whenever the duration of said rich indication exceeds a first lean interval and a second lean interval.

4. The method set forth in claim 3, comprising further the step of increasing a duration of said first lean interval whenever a duration of said lean indication exceeds a first duration limit and not a second duration limit.

5. The method set forth in claim 2, comprising further the step of increasing a duration of said first rich interval whenever a duration of said rich indication exceeds a first duration limit and not a second duration limit.

6. The method as set forth in claim 5, wherein a total interval is substantially equal to or greater than two times said first rich duration limit.

7. The method as set forth in claim 4, wherein said total interval is substantially equal to or greater than two times said first lean duration limit.

8. The method as set forth in claim 1 comprising further the additional steps of producing a base value, producing said rich step value by adding said base value to a rich offset value, producing said lean step value by subtracting a lean offset value from said base value, increasing said base value whenever said fuel delivery rate exceeds a predetermined rich rate limit, and decreasing said base value whenever said fuel delivery rate falls below a predetermined lean rate limit.

9. The method as set forth in claim 8, comprising further the step of responding to a voltage detected from a second exhaust gas oxygen sensor down-stream from said first exhaust gas oxygen sensor.

10. The method as set forth in claim 8, comprising further the step of increasing said base value to a greater value if said voltage measured from said second sensor is below a predetermined value.

11. The method as set forth in claim 9, comprising further the step of responding to said voltage of said second exhaust gas oxygen sensor, said base value being decreased to a lesser value if said voltage measured from said second sensor is above a predetermined value.

12. The method as set forth in claim 4, comprising further the step of decreasing said interval duration by a smaller fraction of said interval duration following execution of a predetermined number of fuel delivery cycles.

13. The method as set forth in claim 12, comprising further the step of decreasing the step value by a fraction of said step value following execution of a predetermined number of fuel delivery cycles.

14. The method as set forth in claim 1, further comprising the step of classifying said first voltage range as being between 850 mV to 1100 mV, classifying said second voltage range as being between 450 mV to 849 mV, classifying said third voltage range as being between 150 mV to 449 mV, and classifying said fourth voltage range as being between 0 mV to 149 mV.

15. In combination, a fuel system which responds to a fuel control signal for varying the rate at which fuel is delivered to an internal combustion engine;

an electronic processor sensing a voltage output of an exhaust gas oxygen sensor located in the exhaust system;

means coupled to said sensor for measuring said oxygen level and for producing rich and lean exhaust indications ranging from a first highest voltage range associated with a very rich exhaust indication, a second voltage range lower than said first range and associated with a rich exhaust indication, a third voltage range lower than said first and second voltage ranges and associated with a lean exhaust indication and a fourth voltage range lower than said first, second and third voltage ranges and associated with a very lean exhaust indication;

control signal generating means coupled to said fuel intake system and responsive to said rich and lean exhaust indications for altering said fuel delivery rate, said signal generating means further comprising, in combination:

means responsive to onset of a lean indication for increasing said fuel delivery to an initial rich step value which continues until onset of a rich exhaust indication or until a predicted rich rate interval expires;

means responsive to expiration of said predicted rich rate interval for progressively increasing said rate until said rich exhaust indication;

means responsive to onset of said rich indication for establishing an initial lean rate value as well as simultaneously calculating a corrected rich step value, said initial lean value continues until onset of a lean indication or until a predicted lean rate interval expires;

means responding to expiration of said lean rate interval by decreasing said fuel delivery rate in a progressive manner from said predetermined lean step value until a lean exhaust indication is produced; and means responding to onset of each lean exhaust indication by abruptly increasing said fuel delivery rate to said corrected rich step value;

whereby fluctuations and magnitude of said rich step value and said lean step value are minimized.

16. The combination set forth in claim 15, wherein said control signal generating means further comprises, in combination, means responsive to persistence of a rich indication for a duration in excess of a first limit for increasing said initial lean rate and means responsive to the persistence of a lean indication for a duration in excess of a second limit for increasing said initial rich rate.

17. The combination set forth in claim 16, wherein said control signal generating means further comprises, in combination, means responsive to the expiration of said lean rate interval for increasing the duration of said lean rate interval, and means responsive to the expiration of said rich rate interval for increasing the duration of said rich rate interval.

18. The combination set forth in claim 17, wherein said first limit is substantially equal to two times said lean rate interval, and said second limit is substantially equal to two times said rich rate interval.

19. The combination set forth in claim 15, wherein said control signal generating means further comprises a memory for storing plural values, means for detecting a rotational speed of said engine to produce a speed signal, means for determining air intake into said engine to develop a load signal, and means responsive to a magnitude of said speed and load signals for selecting said initial rich rate, said initial lean rate, said rich rate interval, and said lean rate interval.

20. A method of controlling a fuel delivery rate at which fuel is supplied to a fuel intake of an internal combustion engine, said method comprising the steps of:

measuring a voltage level from an exhaust gas oxygen sensor located in communication with combustion gases exhausted by the engine so as to produce a rich or lean exhaust indication;

responding to an onset of each lean exhaust indication by abruptly increasing said fuel delivery rate to a predetermined rich step value and thereafter maintaining said delivery rate at said rich step value until onset of a rich exhaust indication or until a predetermined rich step duration expires;

responding to an expiration of said rich step duration by increasing said fuel delivery rate in a progressive manner from said predetermined rich step value until a rich exhaust indication is produced;

responding to an onset of each rich exhaust indication by abruptly decreasing said fuel delivery rate to a predetermined lean step value as well as simultaneously calculating a corrected rich step value which is greater than said initial rich step value and thereafter maintaining said delivery rate at said lean step value until onset of a lean exhaust indication or until a predetermined lean step duration expires;

responding to the expiration of said lean step duration by decreasing said delivery rate in a progressive manner from said predetermined lean step value until a lean exhaust indication is produced; and responding to onset of each lean exhaust indication by abruptly increasing said fuel delivery rate to said corrected rich step value;

whereby fluctuations and magnitude of said rich step value and said lean step value are minimized.

* * * * *